US005500630A

United States Patent [19]

Edwards, Jr. et al.

[11] Patent Number: 5,500,630

[45] Date of Patent: Mar. 19, 1996

[54] SOLID STATE OVERLOAD RELAY MECHANISM

[75] Inventors: Stanley H. Edwards, Jr.; Richard Marshall; Tony R. Robbins, all of Raleigh, N.C.

[73] Assignee: Square D Company, Palatine, Ill.

[21] Appl. No.: 322,630

[22] Filed: Oct. 13, 1994

[51] Int. Cl.[6] ..... H01H 67/02

[52] U.S. Cl. ..... 335/132; 335/202

[58] Field of Search ..... 335/131–132, 335/126, 172–176, 202

[56] References Cited

U.S. PATENT DOCUMENTS

| | | | |
|---|---|---|---|
| 3,671,891 | 6/1972 | Usui et al. | 335/126 |
| 4,724,410 | 2/1988 | Dogenhart | 335/132 |
| 4,899,120 | 2/1990 | Ohtake et al. | 335/132 |
| 5,339,060 | 8/1994 | Blanchard et al. | 335/132 |

*Primary Examiner*—Lincoln Donovan
*Attorney, Agent, or Firm*—Larry I. Golden; David Russell Stacey

[57] ABSTRACT

A solid state overload relay mechanism designed for minimizing the forces required to open an electrical contact associated therewith in the event of a current overload in a protected circuit, and further designed for overcoming residual magnetism in a solenoid initiating the opening of the contact. The contact includes a pair of stationary contacts supported by a base and a pair of movable contact supported by a contact carrier. A latch defines a notch which is normally engaged with a lever. When so engaged, the contact carrier is positioned such that the movable contacts are in contact with the stationary contacts. When the lever becomes disengaged from the latch, the contact carrier is moved and contact between the movable contacts and stationary contacts is broken. The latch is provided with a counterbalance weight to aid in minimizing the force required to return the latch to its original position after the mechanism is tripped. A latch arm extends away from the latch into the path of the lever such that as the lever travels to its extent in an arcuate path, the lever imparts motion on the latch to return it to its initial position, if such has not already occurred. An auxiliary stationary contact pair is supported by an auxiliary stationary contact housing and may be selectively installed in either a normally closed or a normally open position.

24 Claims, 3 Drawing Sheets

SOLID STATE OVERLOAD RELAY MECHANISM

TECHNICAL FIELD

This invention relates to the field of current overload protection devices. More specifically, this invention relates to a solid state overload relay mechanism which may be efficiently operated.

BACKGROUND ART

In the field of overload protection devices it is well known that overload relays are provided for protecting components connected to an electrical circuit in the event the current flowing through the circuit exceeds a predetermined level. An overload relay monitors the current flowing in the protected circuit and sends a signal to cause a contactor in the protected circuit to open when the current flowing in the protected circuit is higher than a preselected level. Conventionally, this is accomplished by an electromechanical trip mechanism which opens a normally closed contact, thereby opening the contactor and removing power to the protected circuit. In a "self-powered" overload relay, the overload relay is powered by one or more current transformers which monitor the protected circuit. The current transformer(s) also provide power to the electromechanical trip mechanism. Therefore, only a small amount of power is available to the overload relay trip mechanism. In conventional overload relay devices, a solenoid is used to convert electrical energy to mechanical energy in order to open the contacts. Because a limited amount of power is supplied to the overload relay device, it is desirable to minimize the mechanical forces required to operate the mechanism employed for opening the contacts.

When an overload condition is experienced, power is supplied to a solenoid in the electromechanical trip mechanism causing a plunger to retract, which subsequently, through a series of levers or other mechanical components, causes the normally closed contacts to open. After the contacts have been opened, it is well known to manually return the opening or unlatching mechanism to its original position. However, residual magnetism in the solenoid may cause the plunger to remain in the retracted position. This increases the required force to be overcome by the return spring.

It is well known that overload relay devices are available with auxiliary contacts. Auxiliary contacts are used for alarms or other warning systems to alert one that the protected circuit has been interrupted. Such auxiliary contacts may be configured to be normally open or normally closed. Auxiliary contacts typically require a biasing spring external to the mechanism, thus requiring the return spring of the mechanism to overcome an additional load when tripped. Further, the applicants are not aware of any prior art devices which provide for selectively alternating between the normally open or normally closed positions without replacing one auxiliary switch with another auxiliary switch.

DISCLOSURE OF THE INVENTION

Therefore, it is an object of this invention to provide a means for minimizing the forces required to operate the mechanism employed for opening the contacts associated with an overload relay device.

It is also an object of the present invention, associated with an overload relay device including a solenoid and solenoid plunger for opening the contacts, to provide a means for returning the solenoid plunger to an extended position without increasing the force required to be overcome by the latch return spring.

A further object of the present invention is to provide auxiliary contacts which may be selectively installed in either a normally open position to a normally closed position without requiring a new auxiliary contact of the desired configuration.

Other objects and advantages will be accomplished by the present invention which is designed for minimizing the forces required to open the contacts associated therewith in the event of a current overload. Moreover, in the preferred embodiment, the mechanism is designed to overcome residual magnetism in the solenoid to extend the solenoid plunger incorporated in the mechanism after the contacts have been opened. Further, the mechanism is designed to provide auxiliary contacts which operate without increasing the force required to be overcome by the latch return spring and may be selectively positioned in either a normally open position or a normally closed position.

The mechanism of the present invention is carried by a base member and is received within an overload relay housing. A pair of stationary contacts is carried by the base member and is normally maintained in a closed position. A contact carrier is provided with at least one flexible blade, with each flexible blade carrying a pair of movable contacts. The contact carrier is biased toward the stationary contacts by a contact return spring such that the movable contacts can make contact with the stationary contacts. The contact carrier is slidably movable away from the stationary contacts such that the movable contacts break contact with the stationary contacts. A solenoid is secured to the base member and carries a plunger. When an overload current in the protected circuit is detected, the electromechanical trip mechanism causes the solenoid to retract the plunger.

When the plunger is withdrawn into a sealed position within the solenoid, a latch is pivoted to release a lever from engagement with a notch defined by the latch. When the lever is disengaged from the latch, the lever is pivoted by a force provided by a a compression spring toward a slide member, and subsequently the contact carrier. The contact carrier is moved in a linear direction away from the stationary contacts, thus breaking contact. A downward force on the slide member provided by a reset button causes the lever to pivot back into engagement with the notch defined by the latch and the contact return spring forces the contact carrier back toward the stationary contacts until contact is once again made.

A distal end of the latch is provided with a receptor for closely receiving a counterbalance weight. A latch return spring is carried between the distal end of the latch and the base member in order to aid in biasing the latch in a direction to maintain the solenoid plunger in an extended position. An arm is defined by the latch and extends away from the latch into the path of the lever such that, as the lever distal end travels to its extent in an arcuate path, if the latch is pivoted such that the solenoid plunger is retracted, the latch arm is engaged by the lever thereby imparting rotational motion on the latch such that the solenoid plunger is extended.

An auxiliary stationary contact pair is supported by an auxiliary stationary contact housing. Two auxiliary contact receptor pairs defined by the base are provided for receiving the auxiliary stationary contact pair in either a normally closed or a normally open position. To accomplish this, the contact carrier is provided with at least two flexible contact blades having two opposing ends, with at least one contact being provided proximate each end thereof. The first flexible blade carried by the contact carrier is provided for engaging a pair of stationary contacts carried by the base member. The second flexible blade is provided for contacting the auxiliary pair of stationary contacts.

A port is provided in the overload relay housing for viewing a portion of the mechanism. If the mechanism is tripped, a portion of the lever is visible through the port. If the mechanism has not been tripped, or has been reset, the lever is not visible through the port. An indicator is provided for indicating the orientation of the auxiliary stationary contacts. Specifically, a raised member is provided on each end of the auxiliary stationary contact housing to correspond to indicia carried by the mechanism housing to indicate the normally closed or normally open function of the auxiliary contact.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A solid state overload relay mechanism incorporating various features of the present invention is illustrated generally at 10 in the figures. The solid state overload relay mechanism, or mechanism 10 is designed for minimizing the forces required to open the contacts 14 associated therewith in the event of a current overload. Moreover, in the preferred embodiment, the mechanism 10 is designed to extend the solenoid plunger 18 incorporated in the mechanism 10 after the contacts 14 have been opened. Further, the mechanism 10 is designed to provide auxiliary stationary contacts 86 which may be selectively installed in either a normally open position or a normally closed position.

Figure 1:
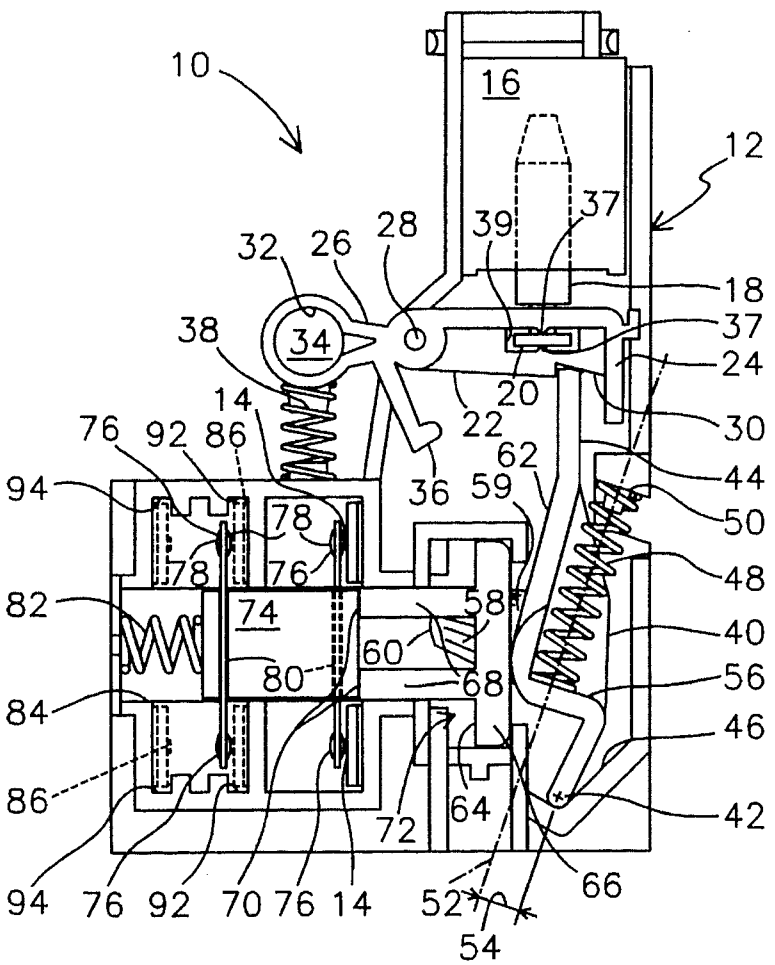
FIG. 1 is a top plan view of a solid state overload relay mechanism constructed in accordance with several features of the present invention showing the stationary contacts in a normally closed position.

Illustrated in FIG. 1 is a mechanism 10 carried by a base member 12. The mechanism 10 is shown in a position where a pair of stationary contacts 14 are closed. This is the condition prior to a current overload. A solenoid 16 is secured to the base member 12 and carries a plunger 18. The plunger 18 is shown in an extended position.

Engaged with the distal end 20 of the plunger 18 is the proximal end 24 of a latch 22. The latch 22 is pivotally mounted to the base 12 by a pin 28 carried by the latch 22 proximate its center and received within an opening defined by the base member 12. The distal end 26 of the latch 22 is provided with a receptor 32 for closely receiving a counterbalance weight 34. A biasing member 38 is carried by at least the distal end 26 of the latch 22 in order to aid in biasing the latch 22 in a direction to maintain the solenoid plunger 18 in an extended position. In the illustrated embodiment, the biasing member 38 is a compression spring secured between the base member 12 and the latch distal end 26. An arm 36 is defined by the latch 22 and extends away from the latch 22 into the path of a lever 40. As will be discussed below, the lever distal end 44 travels in an arcuate path when the solenoid plunger 18 retracts and pulls the latch 22 out of engagement with the lever 40. The latch arm 36 is configured such that as the lever distal end 44 reaches the extent of its travel, if the latch 22 is pivoted such that the solenoid plunger 18 is retracted, i.e., the spring 38 will not overcome the residual magnetism of the solenoid 16, the latch arm 36 is engaged by the lever 40 thereby imparting rotational motion on the latch 22 in order to overcome any residual magnetism in the solenoid 16 such that the solenoid plunger 18 is extended.

A lever 40 is positioned with a distal end 44 engaged by a notch 30 defined in the proximal end 24 of the latch 22. A proximal end 42 of the lever 40 is positioned in an angled receptor 46 carried by the base 12. A biasing member 48 such as the illustrated compression spring is positioned between the lever 40 and the base member 12 such that the proximal end 42 of the lever 40 is biased toward the apex of the angled receptor 46 and such that when the distal end 44 of the lever 40 becomes disengaged from the latch 22, the lever 40 pivots about its proximal end 42. Thus, the apex of the angled receptor 46 serves as the pivot point of the lever 40. One end of the compression spring 48 engages a fixed spring seat 50 defined by the base 12 while the other end of the compression spring 48 engages a shoulder 56 defined by the lever 40. The compression spring 48 serves to pivot the lever 40 in a counter-clockwise direction in the illustrated embodiment when the solenoid plunger 18 is retracted and the latch 22 is pivoted toward the solenoid 16. This particular configuration of the lever 40, the compression spring 48, and the base member 12 including the fixed spring seat 50 and the angled receptor 46 eliminates the need for a pivoting pin, thereby reducing the required force to impart rotation on the lever 40.

The lever 40 further defines a foot 58 extending away from a central portion thereof in the direction of pivot as the lever 40 is released from the latch 22. The foot 58 defines a sloped upper surface 59 from a toe 60 to a heel 61, the sloped upper surface 59 terminating approximately halfway up a side wall 62 of the lever 40. The lever foot 58 is provided to engage the bottom portion of a slide member 64 having a cross-sectional shape similar to the Greek letter "pi". The slide member 64 is positioned such that a horizontal portion 66 rests upon the lever foot 58 when in the cocked position illustrated in FIG. 1. When the lever 40 is released from this position, the lever 40 pivots toward the slide 64 and the sloped upper surface 59 causes the slide 64 to lift until the horizontal portion thereof engages the side wall 62 of the lever 40. At this point, as the lever 40 continues to pivot, the slide 64 is thrust in a linear direction toward a contact carrier 74, the parallel legs 68 of the slide 64 engaging the contact carrier 74 at their respective distal ends 70. The slide 64 is received within a slide receptor 72 defined by the base member 12 such that lateral movement of the slide 64 is substantially prevented.

The contact carrier 74 is slidably received within a contact carrier receptor 84 defined by the base 12 such that lateral movement of the contact carrier 74 is substantially prevented. Carried by the contact carrier 74 is at least one pair of contacts 76 for engaging at least one pair of contacts 14 carried by the base member 12. As illustrated, the preferred embodiment of the contact carrier 74 is provided with two pairs of contacts 76. Each pair of contacts 76 is carried by a flexible blade 80 held by the contact carrier 74 such that opposing ends protrude from the contact carrier 74. The flexible blade 80 provides for a wiping action during the making and breaking of contact. At each end of the flexible blade 80 is disposed one contact 76, with each contact 76 defining a contact surface 78 on each side of the flexible blade 80. It will be understood that only one contact surface 78 for each is required. However, by providing two contact surfaces 78 per contact 76 as described, and by providing two flexible blades 80 as described, the contact carrier 74 is symmetrical such that the orientation of the contact carrier 74 within its receptor 84 is not critical to the functions of the mechanism 10.

Figure 6:
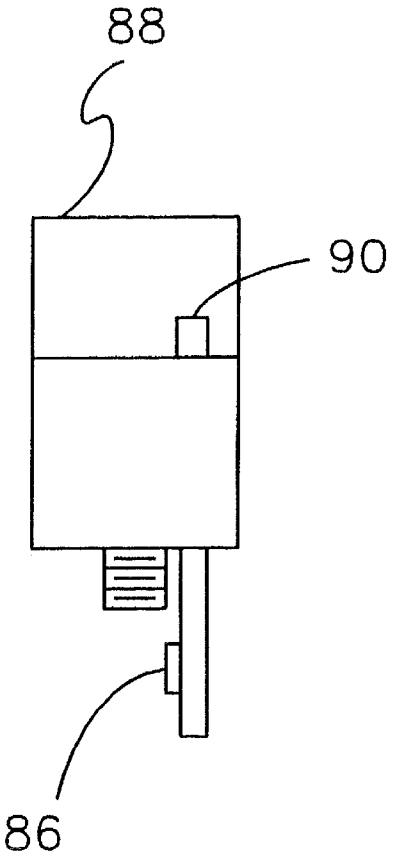
FIG. 6 is a side elevation of the auxiliary stationary contact housing and auxiliary stationary contact pair of FIG. 5.
Figure 5:
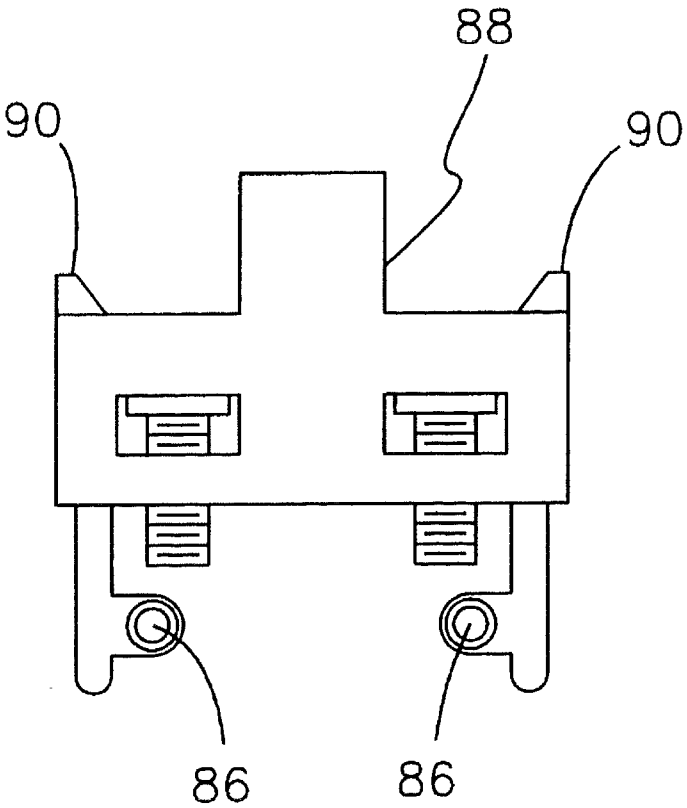
FIG. 5 is a front elevation of the auxiliary stationary contact housing and auxiliary stationary contact pair used in conjunction with the solid state overload relay mechanism of FIG. 1.

The first flexible blade 80 carried by the contact carrier 74 is provided for engaging a pair of stationary contacts 14 carried by the base member 12. The second flexible blade 80 is provided for contacting an auxiliary pair of contacts 86 which may be inserted into one of two auxiliary stationary contact receptor pairs 92, 94. Each contact receptor pair 92, 94 is symmetrical and substantially identical to the other such that a pair of auxiliary stationary contacts 86 may be inserted into a first auxiliary stationary contact receptor pair 92 or may be reversed and inserted into a second auxiliary stationary contact receptor pair 94. As illustrated in FIG. 1 wherein the mechanism 10 is in the latched position, when the auxiliary pair of contacts 86 is placed in the first receptor pair 92, the auxiliary stationary contacts 86 are normally closed. In the second receptor pair 94, the auxiliary stationary contacts 86 are normally open. A preferred embodiment of an auxiliary stationary contact housing 88 is illustrated in FIGS. 5 and 6.

A biasing member such as the contact return spring 82 illustrated in FIG. 1 maintains the contact carrier 74 in a biased position toward the slide member 64. Thus the stationary contacts 14 are maintained in a closed position when the lever 40 and latch 22 are engaged as shown.

Figure 2:
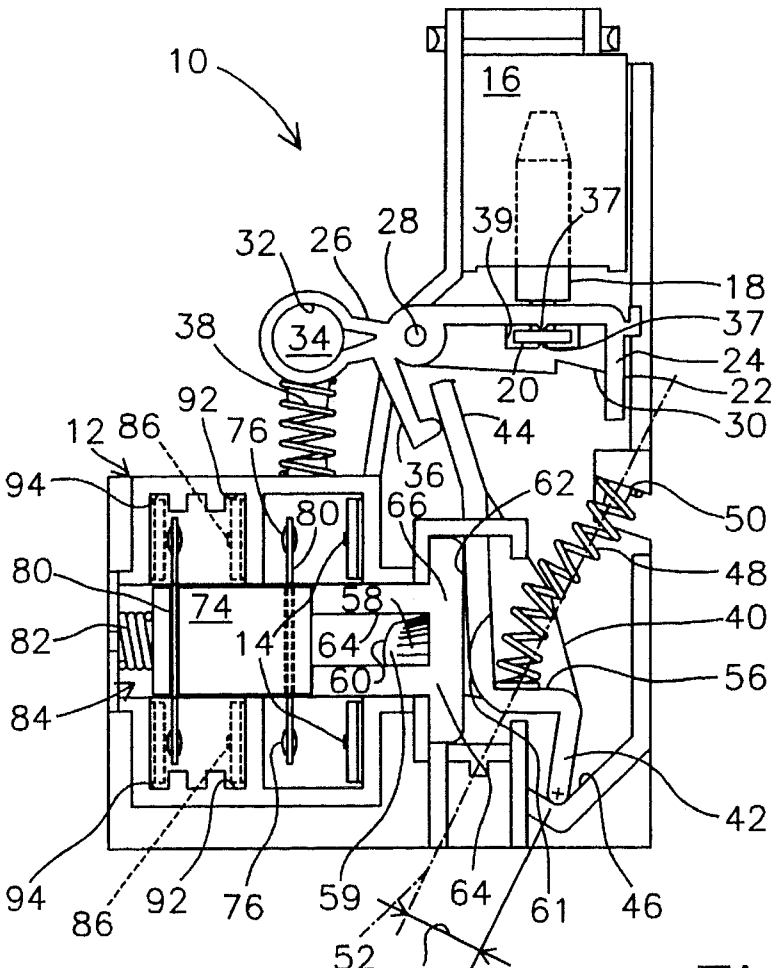
FIG. 2 is a top plan view of the solid state overload relay mechanism of FIG. 1 after the mechanism has been tripped.

As illustrated in FIG. 2, after a current overload has been detected and the mechanism 10 has tripped, or after the mechanism 10 has been manually tripped, the solenoid plunger 18 is retracted, thus pivoting the latch 22 in a counter-clockwise direction about the pin 28. The lever 40 is disengaged from the latch 22 and is thus pivoted about the angled receptor 46 toward the slide member 64. The slide member 64 is raised until it engages the lever side wall 62 when it is moved in an axial direction toward the contact carrier 74. The contact carrier 74 is thus moved such that the stationary contacts 14 are opened. Depending upon the orientation of the auxiliary stationary contacts 86, such are either opened if normally closed or closed if normally open. After the stationary contacts 14 are opened, the solenoid plunger 18 is returned to its extended position. To assist in the extension of the solenoid plunger 18, the latch return spring 38 causes the latch 22 to return to its original orientation. In the event the latch 22 and plunger 18 do not return to the position illustrated in FIG. 1, the distal end 44 of the lever 40 engages the latch arm 36 to initiate pivoting movement of the latch 22 in a clockwise direction.

Figure 3:
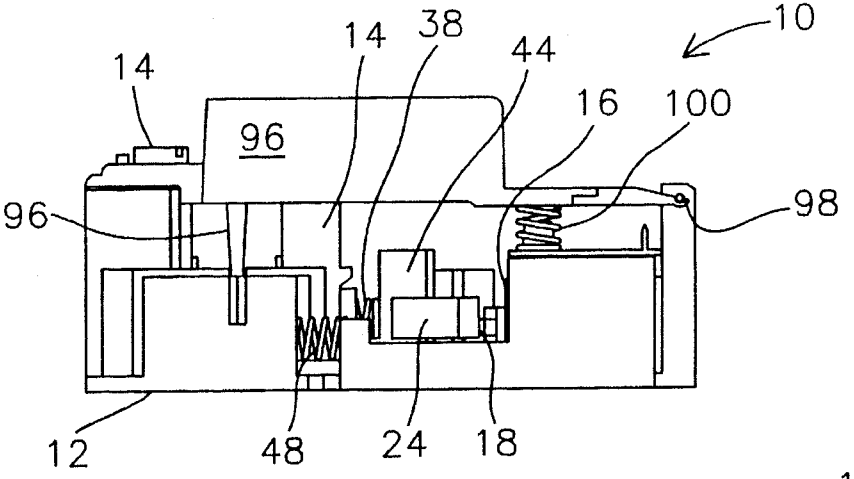
FIG. 3 is a side elevation view of the solid state overload relay mechanism of FIG. 1 showing a reset button for resetting the mechanism after it has been tripped.

In order to return the contact carrier 74 to a position to close at least the stationary contacts 14, a downward force is applied to the slide member 64. As the slide member 64 is forced downward, the sloped upper surface 59 of the lever foot 58 is engaged, thus forcing the lever 40 to pivot about the angled receptor 46 in a clockwise manner until the distal end 44 of the lever 40 engages the notch 30 defined by the latch 22. Upon release of the downward force, the contact carrier return spring 82 forces the contact carrier 74 and the slide member 64 in an axial direction toward the stationary contacts 14 until the stationary contacts 14 are once again closed. The downward force on the slide member 64 is accomplished with a reset button 96 pivotally mounted at one end 98 thereof to the base member 12. As best illustrated in FIG. 3, a reset button return spring 100 is provided for biasing the reset button 96 away from the slide member 64.

Figure 4:
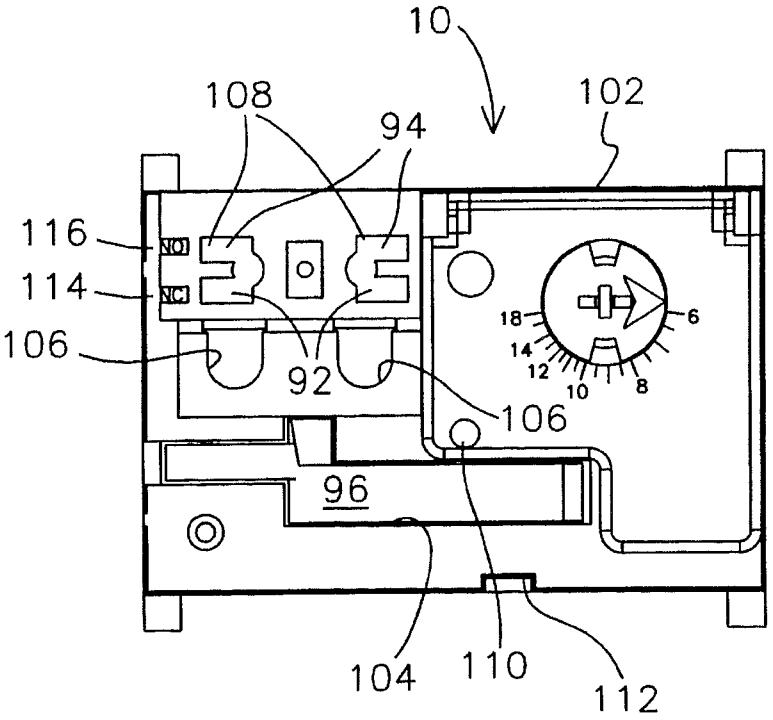
FIG. 4 is a top plan view of the solid state overload relay mechanism of FIG. 1 showing the mechanism received within a mechanism housing.

As illustrated in FIG. 4, the base member 12 and mechanism 10 of the present invention are received within a housing 102. An opening 104 in the housing 102 is provided for passage of the reset button 96. Openings 106 are also provided for access to the stationary contacts 14. Openings 108 are provided for accessing the auxiliary stationary contact receptor pairs 92, 94. Further, a port 110 is provided for viewing the mechanism If the mechanism 10 has been tripped, a portion of the lever 40 is visible through the port 110. If the mechanism 10 has not been tripped, or has been reset, the lever 40 is not visible through the port 110. An opening 112 in the housing 102 is positioned so that the latch can be accessed in order to manually trip the mechanism 10.

FIGS. 5 and 6 illustrate the auxiliary stationary contact housing 88 and auxiliary stationary contacts 86. An indicator 90 is provided for indicating the orientation of the auxiliary stationary contacts 86. As illustrated, a raised member 90 is provided on each end of the auxiliary stationary contact housing 88 to correspond to indicia 114, 116 carried by the mechanism housing 102. Because an auxiliary stationary contact return spring is not required, the mechanism 10 is required to overcome only one contact carrier return spring 82. Thus the force required from the lever spring 48 is reduced, thus reducing frictional forces between the lever 40 and the latch 22 and helping to minimize load on the solenoid 16.

In the mechanism 10 of the present 10 invention, energy is stored in a capacitor as current flows through current transformers carried within the housing. When the current sensed by the overload relay circuit exceeds a preselected level, the electrical energy stored in a capacitor is transformed into mechanical energy for opening contacts that are normally latched in a closed position and for closing contacts that are normally in an open position. This mechanical energy is used as described above. In order to operate the mechanism 10 such that a minimum of energy is required to operate the unlatching function, frictional forces on the latch 22 and any return spring force required to reset the latch 22 must be minimized. The lever 40, angled receptor 46, lever spring 48 and lever spring fixed seat 50 are configured so that the spring force acting along its center of action 52 times the moment arm 54 produces a relatively small moment when the lever 40 is held in the latched position by the latch 22. The normal load exerted by the lever 40 on the latch 22 becomes this moment divided by the lever length between the proximal and distal ends 42, 44 thereof. Frictional force that must be overcome by the solenoid 16 to release the latch 22 is this normal force times the coefficient of friction between the latch 22 and the lever 40. Lever 40 and latch 22 materials are chosen such that the coefficient of friction between the two is minimized. In the preferred embodiment, the lever 40 is fabricated from nylon and the latch 22 is fabricated from acetal.

The solenoid 16 must also overcome the latch return spring 38 force. A counterbalance weight 34, which serves primarily to balance the mass moments about the pin 28 in order to reduce the shock sensitivity of the mechanism 10 due to vibration of the plunger 18, further serves to minimize the latch return spring 38 force. The latch return spring 38 is provided for overcoming the frictional forces of the latch pin 28 and the solenoid plunger 18 in the solenoid 16 as the mechanism 10 is being reset.

In conventional mechanisms, the latch return spring 38 supplying the return force for the solenoid 16 must also overcome any residual magnetism that would tend to hold the solenoid plunger 18 in the retracted or sealed position. In the present invention, to insure that any solenoid residual magnetism does not prevent the mechanism 10 from being reset, the latch arm 36 as described is impacted by the lever 40 as the lever 40 nears the end of travel when the mechanism 10 is tripped. The force that the lever 40 imparts to the latch arm 36 is sufficient to insure that any solenoid residual mechanism is overcome and the solenoid 16 does not remain in the sealed state after current flow to the solenoid 16 ceases. Because the latch return spring force is minimized by the counterbalance weight 34, the force required by the solenoid 16 is reduced and the lever 40 is thus capable of applying any necessary force to the latch arm 36 to overcome any residual magnetism of the solenoid 16.

Force available from the solenoid 16 is a function of the gap of the solenoid 16 when the solenoid 16 is energized. Controlling the tolerances associated with that gap is of major concern. The mechanism 10 is designed to minimize that tolerance by minimizing the number of components in the tolerance loop and by placing all parts and components in line rather than operating through motion reversals as seen in other devices. Included in controlling that gap is the notch 39 defined by the latch 22 that engages the plunger distal end 20 with no clearance between the two. Triangular tabs 37 are defined by the notch 39 to insure a close fit between the plunger distal end 20 and the latch 22. The notch 39 not only aids in controlling the solenoid plunger gap when the mechanism 10 is in the latched position but also prevents relative movement between the latch 22 and lever 40 that would degrade performance under vibration.

The force required to overcome the friction between the latch 22 and lever 40 is minimized as described. However, the force available to move the contact carrier 74 and slide member 64 is maximized. As the lever 40 rotates, the moment arm 54 between the lever spring center of action 52 and the pivot increases causing an increasing moment to be imparted to the lever 40, even though the force on the lever return spring 48 is decreasing. Hence, the force applied by the lever 40 to the slide 64 and contact carrier 74 is maximized through the rotation of the lever 40.

Frictional losses are minimized through selection of materials that minimize coefficient of friction between the parts. To this extent, the lever 40 of the preferred embodiment is fabricated from nylon and the base member 12 is fabricated from polyester. The contact carrier 74 is also fabricated from nylon in order to minimize friction between the contact carrier 74 and the base member 12. The slide 64 is fabricated from acetal for a low coefficient of friction between the slide 64 and the lever 40 and between the slide 64 and the base member 12. Again, it will be understood that other materials may be used to fabricate the individual components of the mechanism of the present invention to achieve similar results.

From the foregoing description, it will be recognized by those skilled in the art that a solid state overload relay mechanism offering advantages over the prior art has been provided. Specifically, the mechanism is designed to minimize the forces required to open the contacts associated therewith in the event of a current overload. Moreover, in the preferred embodiment, the mechanism is designed to overcome residual magnetism in the solenoid in order to extend the solenoid plunger incorporated in the mechanism after the contacts have been opened. Further, the mechanism is designed to provide auxiliary stationary contacts which may be selectively alternated between a normally open position and a normally closed position.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An overload relay mechanism comprising:

at least one pair of stationary electrical contacts carried by a base member;

a solenoid including a plunger and being carried by said base member, said solenoid being in communication with a stored power source, said plunger being retracted when the stored power source discharges through said solenoid in response to a sensed overload current in a protected circuit;

a latch engaged with a distal end of said plunger and pivotally mounted to said base member, said latch defining a notch proximate a proximal end thereof;

a latch biasing member engaged between said base member and said latch for biasing said latch to an orientation such that said plunger is maintained in an extended position;

a lever pivotally supported by said base member at a proximal end thereof, a distal end thereof being engageable with said notch defined by said latch;

a lever biasing member engaged between said base member and said lever for biasing said distal end of said lever toward a distal end of said latch, said lever biasing member maintaining engagement between said notch and said lever distal end while said plunger is extended;

a contact carrier slidably received within a contact carrier receptor defined by said base member, said contact carrier carrying at least one contact blade, each of said at least one contact blade carrying a pair of movable contacts, one each of said pairs of movable contacts being in contact with said at least one pair of stationary electrical contacts when said lever distal end is engaged with said notch defined by said latch; and a contact carrier biasing member for biasing said one each of said pairs of movable contacts toward said at least one pair of stationary electrical contacts to maintain contact when said lever distal end is engaged with said notch defined by said latch.

2. The overload relay mechanism of claim 1 further comprising a slide member interposed between said lever and said contact carrier, said lever defining a foot having a sloped upper surface extending from a toe to a heel of said foot, said sloped upper surface terminating at approximately a midpoint of a height of said lever, said slide member defining a substantially Greek letter "pi"-shaped configuration with a horizontal portion engaging at least said sloped upper surface of said foot and a distal end of each of two parallel members engaging said contact carrier, said slide member being raised as said lever is released from engagement with said notch and said lever distal end is pivoted toward said latch distal end, said slide member engaging said lever side wall during pivoting of said lever and subsequently being moved in a linear direction toward said contact carrier as said lever is pivoted to an extent of travel, said one each of said pairs of movable contacts being moved away from contact with said at least one pair of stationary electrical contacts.

3. The overload relay mechanism of claim 2 further comprising a reset button and a reset button biasing member, said reset button being pivotally mounted to said base member at a proximal end and engaging said slide member proximate a distal end when said lever is disengaged from said notch wherein a downward force applied to said reset button moves said slide member downward and thereby moves said lever in a pivoting direction such that said lever engages said notch defined by said latch, said slide member and said contact carrier being forced toward said lever by said contact carrier biasing member upon release of said reset button, thus moving one each of said pairs of contacts toward said at least one pair of stationary electrical contacts until contact is made, said reset button biasing member being disposed between said base member and said reset button for biasing said reset button away from said slide member.

4. The overload relay mechanism of claim 1 wherein said latch defines an arm extending toward and into a path of travel of said lever distal end when said plunger is retracted into said solenoid, said lever distal end applying force to said arm to overcome residual magnetism in said solenoid and initiate pivotal movement of said latch to extend said plunger from said solenoid.

5. The overload relay mechanism of claim 1 wherein said latch defines a receptor proximate said distal end, said receptor for closely receiving a counterbalance weight, said latch pivoting about a pin disposed centrally along said latch, said counterbalance weight minimizing a force required to return said plunger to an extended position by balancing a weight of said plunger.

6. The overload relay mechanism of claim 3 being received within a mechanism housing, said reset button being received through a first opening defined by said mechanism housing, each of said at least one pair of stationary electrical contacts being accessible through stationary contact openings defined by said mechanism housing.

7. The overload relay mechanism of claim 6 further comprising at least one pair of auxiliary stationary contacts, said at least one pair of auxiliary stationary contacts being carried by an auxiliary stationary contact housing, said mechanism housing defining at least one pair of openings for receiving said at least one pair of auxiliary stationary contacts, said at least one pair of auxiliary stationary contacts being selectively engageable with one of said at least one contact blade carried by said contact carrier in either a normally closed position or a normally open position.

8. The overload relay mechanism of claim 7 wherein said auxiliary stationary contact housing defines an indicator proximate each end thereof and wherein said mechanism housing carries at least one indicator, each of said auxiliary stationary contact housing indicators and said mechanism housing at least one indicator cooperating to readily indicate in which of said normally closed or normally opened positions said at least one pair of auxiliary stationary contacts is positioned.

9. The overload relay mechanism of claim 6 wherein said mechanism housing further defines a view port opening for viewing at least a portion of said overload relay mechanism for determining when said overload relay mechanism has been tripped, at least a portion of said lever being visible through said view port opening when said overload relay mechanism has been tripped.

10. The overload relay mechanism of claim 6 wherein said mechanism housing further defines a latch trip opening for engaging said latch proximal end to manually disengage said lever from said notch defined by said latch.

11. An overload relay mechanism comprising:

at least one pair of stationary electrical contacts carried by a base member;

a solenoid including a plunger and being carried by said base member, said solenoid being in communication with a stored power source, said plunger being retracted when the stored power source discharges through said solenoid in response to a sensed overload current in a protected circuit;

a latch engaged with a distal end of said plunger and pivotally mounted to said base member, said latch defining a notch proximate a proximal end thereof, said latch defining a receptor proximate said distal end, said receptor for closely receiving a counterbalance weight, said latch pivoting about a pin disposed centrally along said latch, said counterbalance weight minimizing a force required to return said plunger to an extended position by balancing a weight of said plunger;

a latch biasing member engaged between said base member and said latch for biasing said latch to an orientation such that said plunger is maintained in an extended position;

a lever pivotally supported by said base member at a proximal end thereof, a distal end thereof being engageable with said notch defined by said latch, said lever defining a foot having a sloped upper surface extending from a toe to a heel of said foot, said sloped upper surface terminating at approximately a midpoint of a height of said lever, said latch defining an arm extending toward and into a path of travel of said lever distal end when said plunger is retracted into said solenoid, said lever distal end applying force to said arm to overcome residual magnetism in said solenoid and initiate pivotal movement of said latch to extend said plunger from said solenoid;

a lever biasing member engaged between said base member and said lever for biasing said distal end of said lever toward a distal end of said latch, said lever biasing member maintaining engagement between said notch and said lever distal end while said plunger is extended;

a slide member defining a substantially pi-shaped configuration with a horizontal portion engaging at least said sloped upper surface of said foot said slide member being raised as said lever is released from engagement with said notch and said lever distal end is pivoted toward said latch distal end, said slide member engaging said lever side wall during pivoting of said lever and subsequently being moved in a linear direction away from said lever as said lever is pivoted to an extent of travel;

a contact carrier slidably received within a contact carrier receptor defined by said base member and engaged by a distal end of each of two parallel members defined by said slide member, said contact carrier carrying at least one contact blade, each of said at least one contact blade carrying a pair of contacts, one each of said pairs of contacts being in contact with said at least one pair of stationary electrical contacts when said lever distal end is engaged with said notch defined by said latch, said one each of said pairs of contacts being moved away from contact with said at least one pair of stationary electrical contacts when said lever distal end is disengaged from said notch defined by said latch;

a contact carrier biasing member for biasing said one each of said pairs of contacts toward said at least one pair of stationary electrical contacts to maintain contact when said lever distal end is engaged with said notch defined by said latch;

a reset button pivotally mounted to said base member at a proximal end and engaging said slide member proximate a distal end when said lever is disengaged from said notch wherein a downward force applied to said reset button moves said slide member downward and thereby moves said lever in a pivoting direction such that said lever engages said notch defined by said latch, said slide member and said contact carrier being forced toward said lever by said contact carrier biasing member upon release of said reset button, thus moving one each of said pairs of contacts toward said at least one pair of stationary electrical contacts until contact is made; and a reset button biasing member disposed between said base member and said reset button for biasing said reset button away from said slide member.

12. The overload relay mechanism of claim 11 being received within a mechanism housing, said reset button being received through a first opening defined by said mechanism housing, each of said at least one pair of stationary electrical contacts being accessible through stationary contact openings defined by said mechanism housing.

13. The overload relay mechanism of claim 12 further comprising at least one pair of auxiliary stationary contacts, said at least one pair of auxiliary stationary contacts being carried by an auxiliary stationary contact housing, said mechanism housing defining at least one pair of openings for receiving said at least one pair of auxiliary stationary contacts, said at least one pair of auxiliary stationary contacts being selectively engageable with one of said at least one contact blade carried by said contact carrier in either a normally closed position or a normally open position.

14. The overload relay mechanism of claim 13 wherein said auxiliary stationary contact housing defines an indicator proximate each end thereof and wherein said mechanism housing carries at least one indicator, each of said auxiliary stationary contact housing indicators and said mechanism housing at least one indicator cooperating to readily indicate in which of said normally closed or normally opened positions said at least one pair of auxiliary stationary contacts is positioned.

15. The overload relay mechanism of claim 12 wherein said mechanism housing further defines a view port opening for viewing at least a portion of said overload relay mechanism for determining when said overload relay mechanism has been tripped, at least a portion of said lever being visible through said view port opening when said overload relay mechanism has been tripped.

16. The overload relay mechanism of claim 12 wherein said mechanism housing further defines a latch trip opening for engaging said latch proximal end to manually disengage said lever from said notch defined by said latch.

17. A overload relay mechanism comprising:

at least one pair of stationary electrical contacts carried by a base member;

a solenoid including a plunger and being carried by said base member, said solenoid being in communication with a stored power source, said plunger being retracted when the stored power source discharges through said solenoid in response to a sensed overload current in a protected circuit;

a latch engaged with a distal end of said plunger and pivotally mounted to said base member, said latch defining a notch proximate a proximal end thereof;

a latch biasing member engaged between said base member and said latch for biasing said latch to an orientation such that said plunger is maintained in an extended position;

a lever pivotally supported by said base member at a proximal end thereof, a distal end thereof being engageable with said notch defined by said latch;

a lever biasing member engaged between said base member and said lever for biasing said distal end of said lever toward a distal end of said latch, said lever biasing member maintaining engagement between said notch and said lever distal end while said plunger is extended;

a contact carrier slidably received within a contact carrier receptor defined by said base member, said contact carrier carrying at least one contact blade, each of said at least one contact blade carrying a pair of contacts, one each of said pairs of contacts being in contact with said at least one pair of stationary electrical contacts when said lever distal end is engaged with said notch defined by said latch;

a contact carrier biasing member for biasing said one each of said pairs of contacts toward said at least one pair of stationary electrical contacts to maintain contact when said lever distal end is engaged with said notch defined by said latch;

a mechanism housing for receiving said overload relay mechanism, each of said at least one pair of stationary electrical contacts being accessible through stationary contact openings defined by said mechanism housing; and at least one pair of auxiliary stationary contacts, said at least one pair of auxiliary stationary contacts being carried by an auxiliary stationary contact housing, said mechanism housing defining at least one pair of openings for receiving said at least one pair of auxiliary stationary contacts, said at least one pair of auxiliary stationary contacts being selectively engageable with one of said at least one contact blade carried by said contact carrier in either a normally closed position or a normally open position.

18. The overload relay mechanism of claim 17 further comprising a slide member interposed between said lever and said contact carrier, said lever defining a foot having a sloped upper surface extending from a toe to a heel of said foot, said sloped upper surface terminating at approximately a midpoint of a height of said lever, said slide member defining a substantially Greek letter "pi"-shaped configuration with a horizontal portion engaging at least said sloped upper surface of said foot and a distal end of each of two parallel members engaging said contact carrier, said slide member being raised as said lever is released from engagement with said notch and said lever distal end is pivoted toward said latch distal end, said slide member engaging said lever side wall during pivoting of said lever and subsequently being moved in a linear direction toward said contact carrier as said lever is pivoted to an extent of travel, said one each of said pairs of contacts being moved away from contact with said at least one pair of stationary electrical contacts.

19. The overload relay mechanism of claim 18 further comprising a reset button and a reset button biasing member, said reset button being pivotally mounted to said base member at a proximal end and engaging said slide member proximate a distal end when said lever is disengaged from said notch wherein a downward force applied to said reset button moves said slide member downward and thereby moves said lever in a pivoting direction such that said lever engages said notch defined by said latch, said slide member and said contact carrier being forced toward said lever by said contact carrier biasing member upon release of said reset button, thus moving one each of said pairs of contacts toward said at least one pair of stationary electrical contacts until contact is made, said reset button biasing member being disposed between said base member and said reset button for biasing said reset button away from said slide member, said reset button being received through a reset button opening defined by said mechanism housing.

20. The overload relay mechanism of claim 17 wherein said latch defines an arm extending toward and into a path of travel of said lever distal end when said plunger is retracted into said solenoid, said lever distal end applying force to said arm to overcome residual magnetism in said solenoid and initiate pivotal movement of said latch to extend said plunger from said solenoid.

21. The overload relay mechanism of claim 17 wherein said latch defines a receptor proximate said distal end, said receptor for closely receiving a counterbalance weight, said latch pivoting about a pin disposed centrally along said latch, said counterbalance weight minimizing a force required to return said plunger to an extended position by balancing a weight of said plunger.

22. The overload relay mechanism of claim 17 wherein said auxiliary stationary contact housing defines an indicator proximate each end thereof and wherein said mechanism housing carries at least one indicator, each of said auxiliary stationary contact housing indicators and said mechanism housing at least one indicator cooperating to readily indicate in which of said normally closed or normally opened positions said at least one pair of auxiliary stationary contacts is positioned.

23. The overload relay mechanism of claim 17 wherein said mechanism housing further defines a view port opening for viewing at least a portion of said overload relay mechanism for determining when said overload relay mechanism has been tripped, at least a portion of said lever being visible through said view port opening when said overload relay mechanism has been tripped.

24. The overload relay mechanism of claim 17 wherein said mechanism housing further defines a latch trip opening for engaging said latch proximal end to manually disengage said lever from said notch defined by said latch.

* * * * *